US010889962B2

(12) United States Patent
Michael Raj et al.

(10) Patent No.: US 10,889,962 B2
(45) Date of Patent: Jan. 12, 2021

(54) INTELLIGENT MECHANICAL LINKAGE PERFORMANCE SYSTEM

(71) Applicant: DEERE & COMPANY, Moline, IL (US)

(72) Inventors: Antony Maria Thomas Benny Michael Raj, Coimbatore (IN); Adam Eisbach, East Dubuque, IL (US)

(73) Assignee: Deere & Company, Moline, IL (US)

( * ) Notice: Subject to any disclaimer, the term of this patent is extended or adjusted under 35 U.S.C. 154(b) by 156 days.

(21) Appl. No.: 16/280,927

(22) Filed: Feb. 20, 2019

(65) Prior Publication Data

US 2020/0263391 A1 Aug. 20, 2020

(51) Int. Cl.

| | |
|---|---|
| ***E02F 9/20*** | (2006.01) |
| ***E02F 3/36*** | (2006.01) |
| ***E02F 3/34*** | (2006.01) |
| ***E02F 9/26*** | (2006.01) |

(52) U.S. Cl.

CPC ..... *E02F 9/2062* (2013.01); *E02F 3/3414* (2013.01); *E02F 3/3622* (2013.01); *E02F 9/265* (2013.01)

(58) Field of Classification Search

CPC ..... E02F 9/2062; E02F 3/3622; E02F 3/3414; E02F 9/265

See application file for complete search history.

(56) References Cited

U.S. PATENT DOCUMENTS

| | | | | |
|---|---|---|---|---|
| 8,644,964 | B2 | 2/2014 | Hendron et al. | |
| 2004/0074563 | A1 | 4/2004 | MacNeil et al. | |
| 2012/0232756 | A1* | 9/2012 | Yuan | E02F 9/2296 701/41 |
| 2016/0222623 | A1 | 8/2016 | Wagner | |
| 2017/0285655 | A1* | 10/2017 | Katou | G09B 29/00 |
| 2019/0010966 | A1 | 1/2019 | Bellows et al. | |

FOREIGN PATENT DOCUMENTS

| | | | |
|---|---|---|---|
| JP | 2016176298 | A | 10/2016 |
| WO | 2017128272 | A1 | 8/2017 |

* cited by examiner

*Primary Examiner* — Rodney A Butler

(57) ABSTRACT

A work machine having a controller configured to receive a first position signal from a first boom position sensor, a second position signal from a second boom position sensor, and a load signal from the load measuring device, wherein the controller is further configured to calculate a map of hydraulic capacities within an envelope of movement for one or more of a first and a second actuators based on the first position signal, the second position signal, and the load signal, and generate a lift path of movement for the pin through at least a portion of the envelope based on the hydraulic capacities, wherein the movement envelope being smaller than the envelope.

20 Claims, 13 Drawing Sheets

INTELLIGENT MECHANICAL LINKAGE PERFORMANCE SYSTEM

CROSS-REFERENCE TO RELATED APPLICATIONS

N/A

FIELD OF THE DISCLOSURE

The present disclosure relates to a work machine.

BACKGROUND

In the forestry industry, for example, grapple skidders may be used to transport harvested standing trees from one location to another. This transportation typically occurs from the harvesting site to a processing site. Alternatively, in the construction industry, excavators may be used to transport gravel, dirt, or other movable material. In both work machines, an implement for carrying a payload is coupled to a boom assembly that includes multiple pivoting means. Actuators may then be arranged on the boom assembly to pivot the booms relative to each other and thereby move the implement.

When multiple booms are arranged in a boom assembly, controlled movement of the implement may be relatively difficult, requiring significant investment in operator training. This can be especially difficult to maneuver with the variable payloads and physical limitations of the actuators. Under conventional control systems, for example, an operator may move a joystick along one axis to move one more actuators that pivot a first boom section, and move the joystick along another axis to move actuators that pivot a second boom section. In theory, an operator may control the two booms such that the aggregate movement of all the actuators causes desired movement of the implement carrying a payload to a desired position. However, dependent upon the degree of the payload, the relative center of mass of payload, and the changing geometry of the two booms as they move relative to each other and the vehicle, the changing geometry introduces significant complexity to the relationships between actuator movement and movement of the implement. More specifically, limitations of an actuator's load capacity because of variable payload may affect the precise control of the implement and will be relatively difficult without significant skill and practice.

Movement of the boom can vary dramatically based upon the location of boom assembly components with respect to the work machine frame. Moreover, movement of the boom assembly can vary dramatically based on the incline of the surface a work machine is situated because it changes the relative orientation of the downward gravitational pull of the payload and/or implement relative to the directional pull of the actuators coupled to the boom assembly. This variability in the payload's orientation ultimately makes it difficult for a user to accurately control boom operation, especially when traversing through rugged terrain. Therein lies a need for a control system with improved boom control for moving payloads.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes an intelligent mechanical linkage performance system for a work machine during a payload moving operation.

According to an aspect of the present disclosure, a work machine may include a frame, a ground-engaging mechanism configured to support the frame on a surface, a boom assembly, a load measuring device, a pin, and a controller. The boom assembly, coupled to the frame of the work machine, may include a first section pivotally coupled to the frame and moveable relative to the frame by a first actuator, and a second section pivotally coupled to the first section and moveable relative to the first section. A first boom position sensor may be coupled to the first section. A second boom position sensor may be coupled to the second section. The load measuring device may be coupled to the boom assembly and configured to generate a load signal indicative of a payload. The pin may be figuratively coupled to the second section at a location distal from the first section. The pin may have an envelope throughout which the pin is moveable by the first section and the second section. The controller may be configured to receive a first position signal from the first boom position sensor, a second boom position signal from the second boom position sensor, and the load signal from the load measuring device. The controller may further be configured to calculate a map of hydraulic capacities within the envelope for one or more of the first and the second actuators based on the first position signal, the second position signal, and the load signal. The controller may further generate a movement envelope of movement of the pin through at least a portion of the envelope based on the hydraulic capacities. The movement envelope may be smaller than the envelope.

The pin may couple an implement to the second section.

The map of hydraulic capacities may comprise a series of nodes representing the hydraulic capacities of one or more of the first and the second actuators throughout the envelope in real-time.

The movement envelope may comprise a lift path of the pin from a first pin position to a second pin position through nodes with sufficient hydraulic capacity.

The envelope may display on a user input interface through a color code. The color code may be based on a degree of hydraulic capacity.

The load measuring device may comprise a first load measuring sensor coupled to the first section, and a second load measuring sensor coupled to the second section.

The controller may further receive an inclination signal from an inclination sensor coupled to the work machine when calculating the map of hydraulic capacities. The inclination sensor may determine the inclination of the horizontal longitudinal axis of the work machine and the controller may modify the load signal based on the inclination signal.

The controller may be further configured to inhibit movement of the pin to a plurality of nodes within the envelope having insufficient hydraulic capacity for a payload.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

DETAILED DESCRIPTION

The following describes one or more example implementations of the disclosed system for intelligent control of the implement, as shown in the accompanying figures of the drawings. Generally, the disclosed control system (and work machines on which they are implemented) allow for improved operator control of the movement of the implement as compared to conventional systems.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Figure 1:
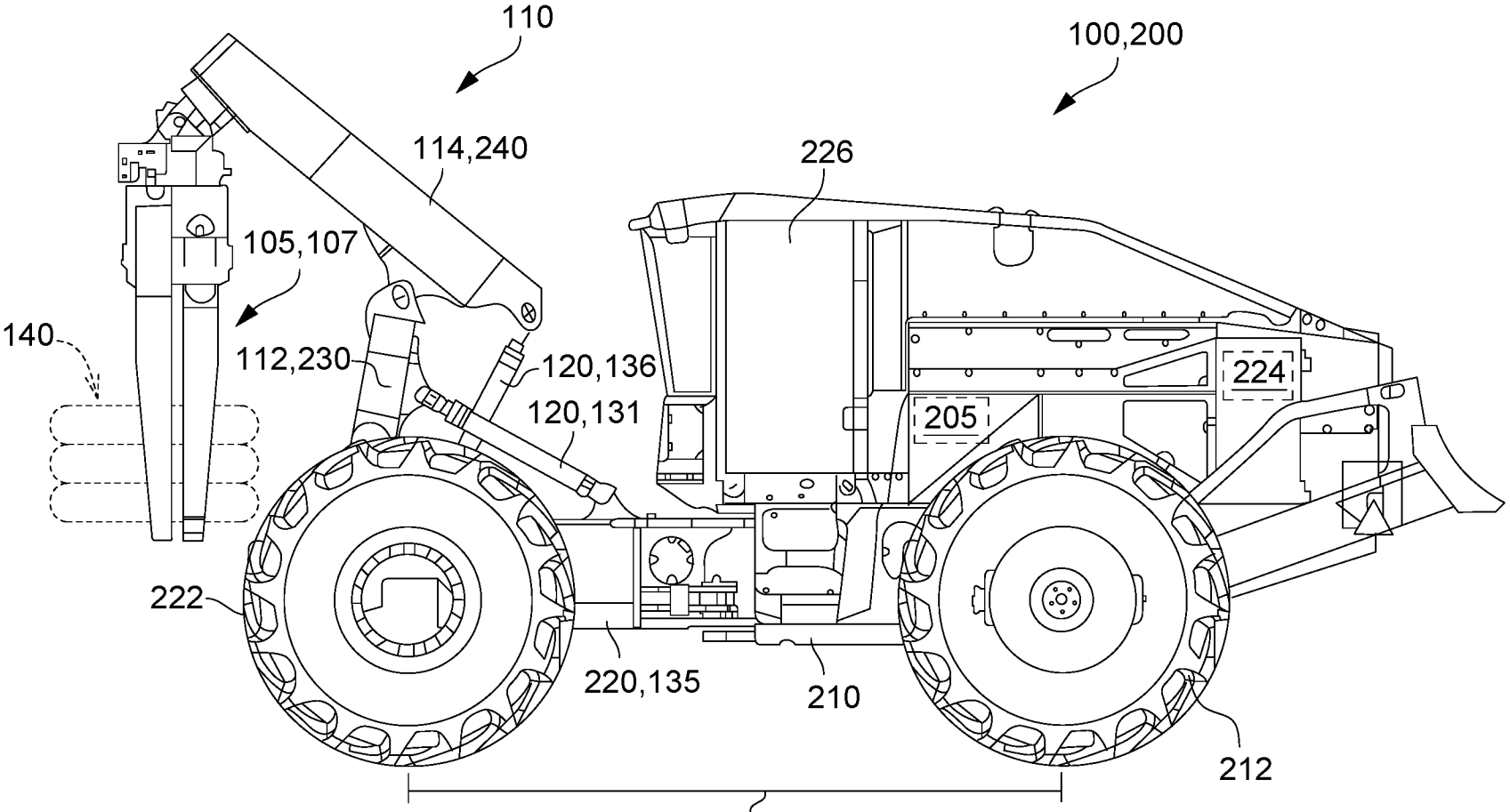
FIG. 1 is a side view of a first exemplary embodiment of a work machine having an intelligent mechanical linkage performance system.
Figure 10:
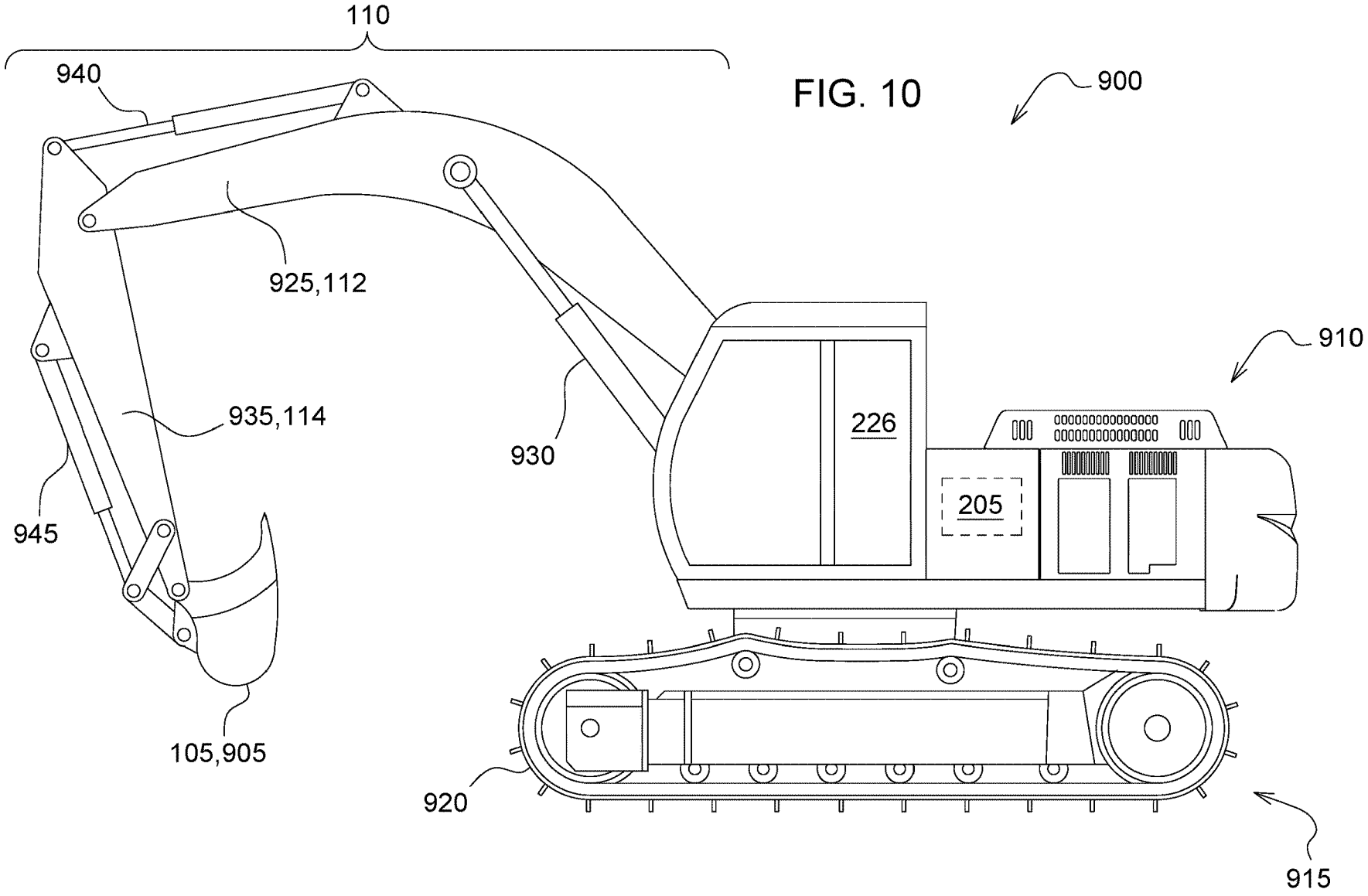
FIG. 10 is a side view of a second exemplary embodiment of a work machine having an intelligent mechanical linkage performance system.

Referring now to the drawings and with specific reference to FIG. 1, an implement 105 may be coupled to a work machine 100 by a boom assembly 110 and the boom assembly 110 may be moved by various actuators 120 to accomplish tasks with the implement 105. Note that actuators 120 may be electric or hydraulic. Although, hydraulic cylinder is repeatedly referenced throughout, an electric actuator may be interchangeable with a hydraulic actuator. Discussion herein may sometimes focus on the example application of moving an implement 105 wherein the work machine 100 is configured as a grapple skidder 200 in a first exemplary embodiment (as shown in FIG. 1) and configured as an excavator 900 (as shown in FIG. 10) in a second exemplary embodiment, with actuators 120 generally configured as hydraulic cylinders 125 for moving an implement 105. In the instance of a grapple skidder 200 as shown in FIG. 1, a grapple 107 is used for moving a payload 140. Grapple skidders 200 are generally used to move forestry related payloads such as felled trees and processed logs with use of an implement 105, the grapple 107, wherein the grapple may mimic pincher type movement. In the instance of an excavator 900, as shown in FIG. 10, a bucket 905 is used for moving a payload 140. In other applications, other configurations are possible. In some embodiments, for example, forks, felling heads or other implements with a payload carrying capacity may also be configured in other boom assembly configurations. With respect to the present disclosure, work machines in some embodiments may be configured as diggers, forwarders, loaders, feller bunchers, concrete crushers and similar machines, or various other embodiments.

As shown in FIGS. 2 through 8, with continued reference to FIG. 1, the disclosed intelligent mechanical linkage performance system 300 may be used to receive position signals 305 of an implement 105 based on real-time positions of the actuators 120 relative to a frame 130, and load signals 288 of the payload 140 carried by the implement 105 based on a real-time load sensed. In the present disclosure frame 135 may be shown as the frame of the work machine 100. However, the frame 130 may also be an arbitrary point on the work machine 100 or in the digital/electronic space to create a point(s) by which the relative positions of the actuators 120 may be measured. For example, in a hydraulic actuator it may be the relative position of the cylinder along the length of the rod.

The intelligent mechanical linkage performance system 300 may then determine position commands for various actuators 120 such that the commanded movement of the actuators 120 provides an optimal pathway (hereinafter referred to as a lift path 710) of commanded movement of the implement 105 depending on the theoretical load capacity of each respective actuator 120 along various positions within an envelope 400 of movement, and actual load requirements for moving the payload 140 from a first position 720 in envelope of movement 400 to a second position 730 in envelope of movement 400 relative to the frame 130. Note that the first position 720 and the second position 730 are not predefined positions. Rather the first position may be a current position or starting position of the boom assembly within or along the perimeter 312 (shown with dotted line) of the envelope of movement 400 where the grapple 107 may have at that instant or before engaged with a payload 140. The second position 730 may be a desired position within or along the perimeter 312 of the envelope of movement 400. The second position 730 in grapple skidder may be a transport position where the grapple 107 has sufficiently lifted the payload 140 (most likely a group of felled trees) to be either lifted off the ground or dragged to its next destination.

The envelope of movement 400 of movement may be defined by the range of possible movement of the distal end 115 of the boom assembly 110 where an implement 105 may be coupled. This perimeter 312 of the envelope of movement 400 is defined by one or more hydraulic cylinders 125 coupled to the boom assembly 110 being at a fully extended or retracted position. In this way, optimized planned movement along a limited pathway in the envelope of movement 400 may be converted to position commands for the relatively complex movement of multiple actuators 120, providing optimal movement of the implement 105 with the given payload 140. This advantageously reduces reliance on an operator's perception or the operator's expertise in that an operator may directly indicate a desired movement for the payload 140 with respect to at least one actuator 120 towards the second position 730 and the intelligent mechanical linkage performance system 300 maps a suggested lift path 710 (i.e. planned movement along a limited pathway through the envelope of movement 400) for subsequent actuators 120 relative to frame 130 based on the payload 140. The available capacity from the hydraulic system 310 may be determined primarily by remaining rod length in a hydraulic cylinder. However, hydraulic fluid volume, actuator pressure, disposition of the valves within the hydraulic system, architecture of the system such as closed loop systems or open loop systems, are a few other possible variables that may factor into available capacity calculations. Each of these may individually or summarily indicate the position of the actuator 120.

The lift path 710 defines portions of the envelope of movement 400 wherein each respective actuator 120 has sufficient available capacity to move the measured payload 140. For example, an instance may occur where retracting one actuator 120 may leave insufficient rod length for a subsequent actuator to provide the pull or lift force needed to move the payload 140. With the intelligent mechanical linkage performance system 300, an operator may cause relatively precise movement of each respective actuator 120 with the detailed guide for movement of an individual actuator 120 and as a result the implement 105, in the envelope of movement 400, or possibly mapping of a lift path 710 within the envelope of movement 400. Alternatively, the control may restrict movement of the actuators and/or pin 215 to a movement envelope wherein the movement envelope is smaller than the envelope of movement 400. In a semi-automatic control mode 365, the intelligent mechanical linkage performance system 300 merely provides guidance to the operator with visual and/or haptic feedback.

By way of applying the above to a grapple skidder 200, the intelligent mechanical linkage performance system 300 may function in an automatic mode 375 wherein the operator may cause movement of a first section 112 of a boom assembly 110 and the controller 255 may respond by automatically moving the respective actuator(s) 120 of a second section 114 of the boom assembly 110 and therefore the implement 105, in the envelope 400 of movement, or mapping of a lift path 710 within the envelope 400 from the first position 720 to the second position 730.

Generally, a boom assembly 110 may include at least two sections that are separately movable by different respective actuators 120. For example, a first section 112 of a boom assembly 110 may be coupled to a frame 135 of the work machine 100, and may be moved (e.g. pivoted) relative to the frame 135 of the work machine 100 by a first actuator 131. A second section of the boom assembly 114 may be coupled to the first section 112 of the boom assembly 110, and may be moved (e.g. relative to the first section 112 by a second actuator 136). An implement 105 may be coupled to the second section 114 and, in some embodiments, may be moved (e.g. pivoted) relative to the second section 114 by a third actuator 945 (e.g. as shown in FIG. 10). In this way, movements of the first 131, second 136, and possibly the third actuator 945 may correspond to distinct movements of the first section 112 of the boom assembly 110, the second section 114 of the boom assembly 110, and an implement 105, respectively. Further, due to the configuration of the boom assembly 110, a movement of the first section 112 may cause a corresponding movement of the second section 114 and the implement 105 relative to the frame 135 of the work machine 100, and a movement of the second section 114 may cause a corresponding movement of the implement 105 relative to the first section 112 and/or the frame 135 of the work machine 100.

Figure 2:
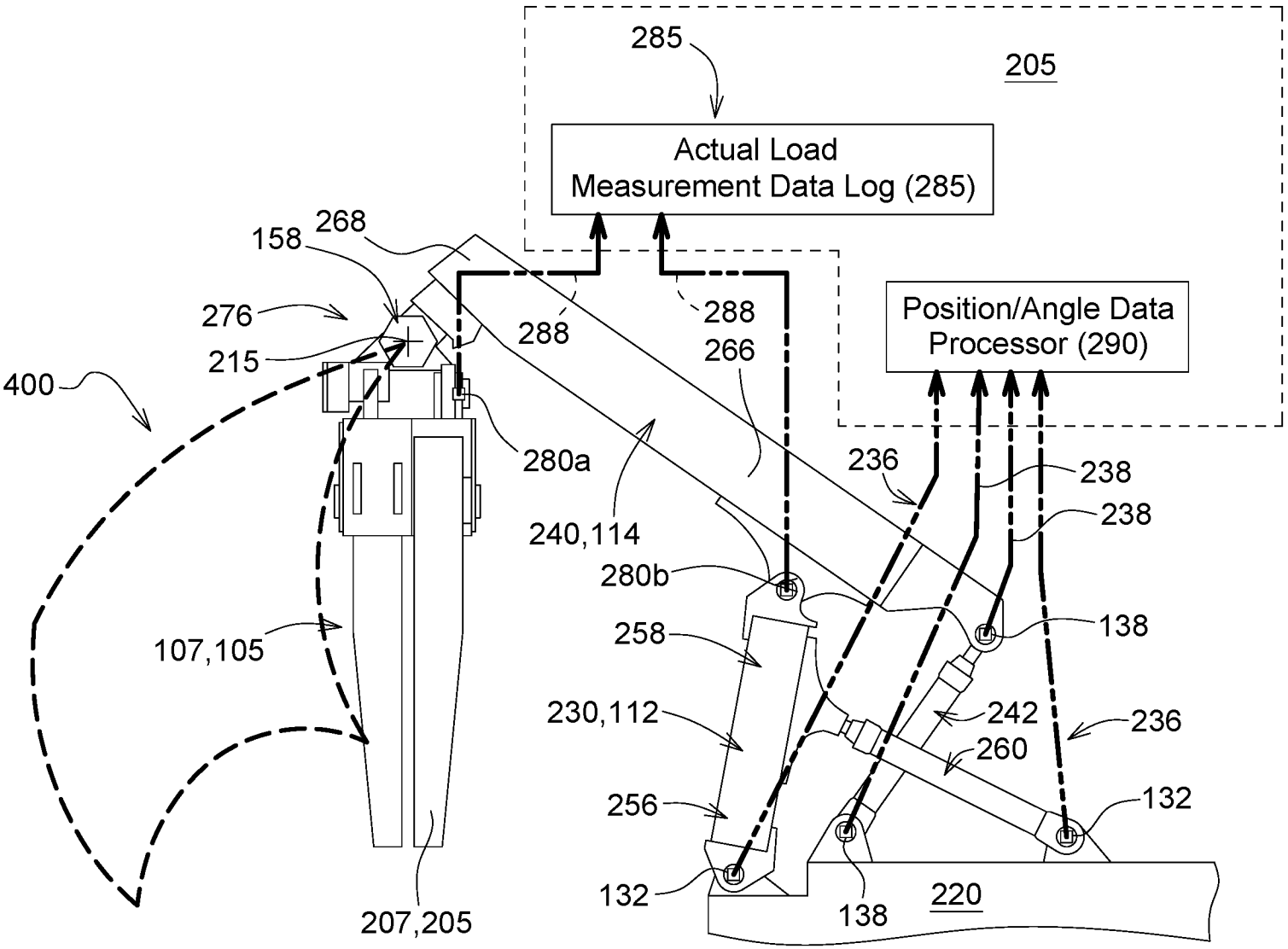
FIG. 2 is a detailed side view of the boom assembly of the first exemplary embodiment shown in FIG. 1 as it relates to a portion of the intelligent performance control module.
Figure 8:
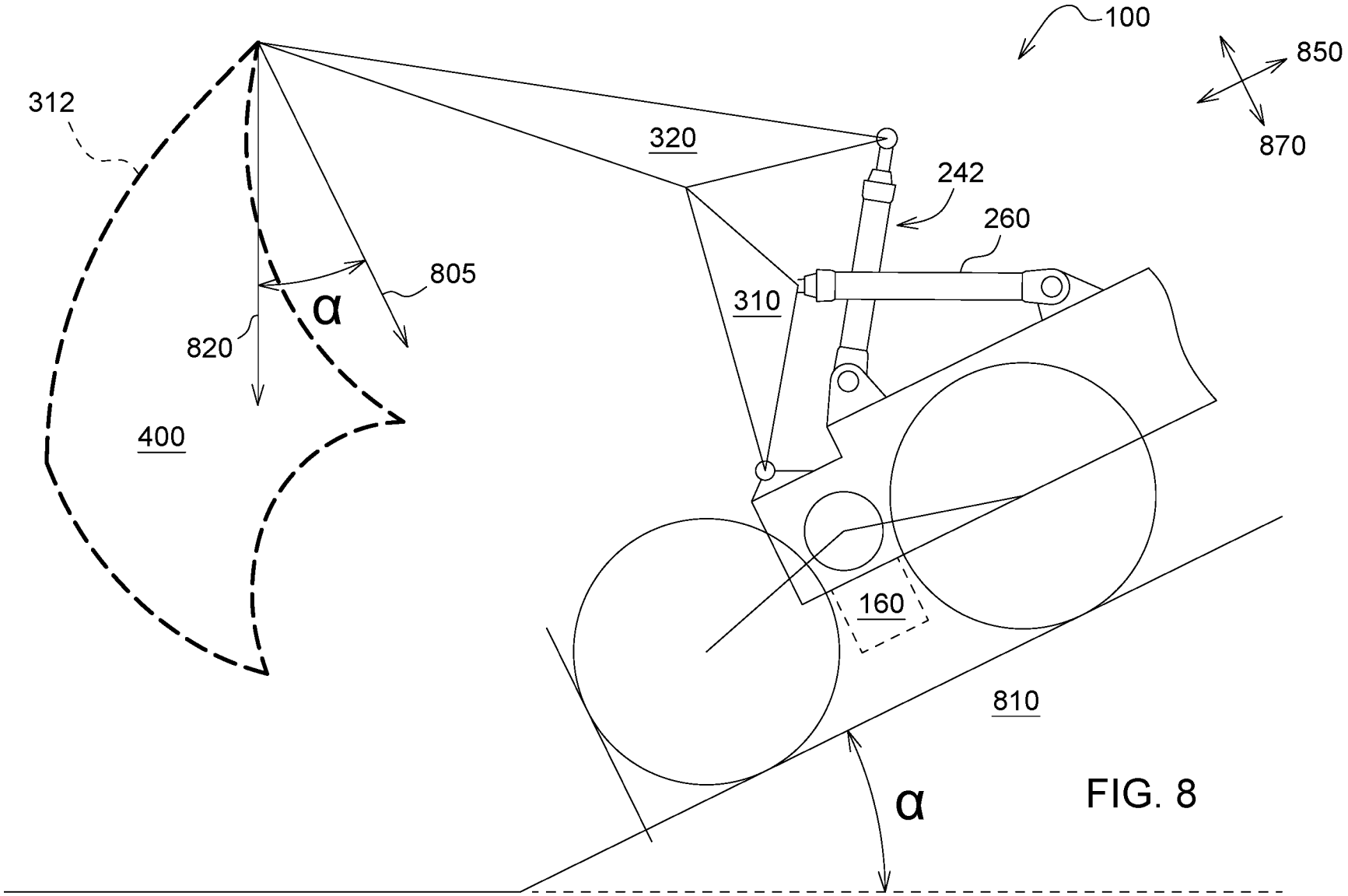
FIG. 8 is a line schematic of the first exemplary embodiment demonstrating the effect of an incline on the intelligent mechanical linkage performance system.

Now referring to FIGS. 1 and 2, the grapple skidder 200 (also referred to herein as "skidder"), having an intelligent mechanical linkage performance system 300 (as shown in FIGS. 2 and 8) is shown. A skidder 200 may be used to transport harvested trees over natural grounds such as a forest. Please note that while the figures and descriptions may relate to a four-wheeled skidder in this first exemplary embodiment, it is to be understood that the scope of the present disclosure extends beyond a four-wheeled skidder as noted above and may include a six-wheeled skidder, or some other vehicle, and the term "work machine" or "vehicle" may also be used. The term "work machine" is intended to be broader and encompass other work machines besides a skidder 200 such as the second exemplary embodiment of an excavator discussed later.

The skidder 200 includes a front vehicle frame 210 coupled to a rear vehicle frame 220. Front wheels 212 support the front vehicle frame 210, and the front vehicle frame 210 supports an engine compartment 224 and operator cab 226. Rear wheels 222 support the rear vehicle frame 220, and the rear vehicle frame 220 supports a boom assembly 110. Although the ground-engaging mechanism is described as wheels in this embodiment, in an alternative embodiment, tracks or combination of wheels and tracks may be used. The engine compartment 224 houses a vehicle engine or motor, such as a diesel engine which provides the motive power for driving the front and rear wheels (212, 222) and for operating the other components associated with the skidder 200 such as the actuators 120 to move the boom assembly 110. The operator cab 226, where an operator sits when operating the work machine 100, includes a plurality of controls (e.g. joysticks, pedals, buttons, levers, display screens, etc.) for controlling the work machine 100 during operation thereof.

The boom assembly 110 is coupled to the frame 135. In the embodiment of a skidder 200, the frame 135 may comprise one or more of the front vehicle frame 210, the rear vehicle frame 220, and/or an arbitrary coordinate system assigned (not shown) stored in the controller 205. In the embodiment disclosed herein, the frame 135 is noted as the rear vehicle frame 220, for simplicity. The boom assembly 110 comprises a first section 112 (i.e. arch section 230)

pivotally coupled to the frame 135 and moveable relative to the frame 135 by a first actuator 131 wherein a first boom position sensor 132 is coupled to the first section of the boom assembly 112. The first boom position sensor 132 may comprise of one or more sensors indicating the position of the first section 112. The detailed view of the portion of the first exemplary embodiment in FIG. 2 shows that the first boom position sensor 132 comprises of multiple sensors strategically positioned.

The boom assembly 110 further comprises a second section 114 (i.e. the boom section 240) pivotally coupled to the first section 112 and moveable relative to the first section 112 by a second actuator 136 wherein a second boom position sensor 138 is coupled to the second section 114. The second boom position sensor 138 may comprise of one or more sensors indicative of the position of the second section 114. The second boom position sensor 138 also comprises of multiple sensors strategically positioned.

The locations of position sensors may depend on the linkage kinematics of the boom assembly 110 or components engaging the boom assembly 110 of a respective work machine 100 as well as the type of position sensor. The position sensors (132, 138) feed first and second position signals (236, 238) into the position/angle data processor 290.

Figure 9:
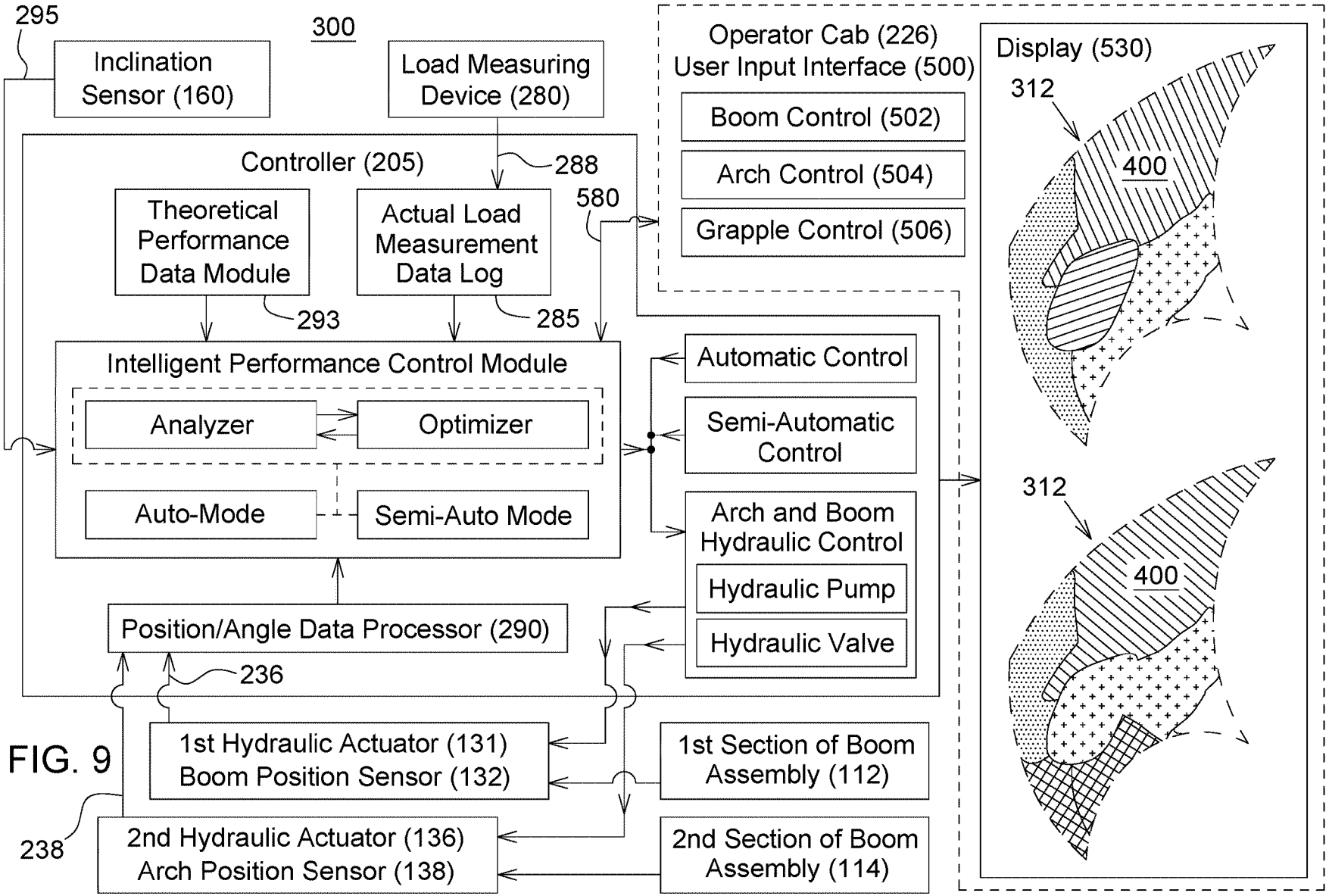
FIG. 9 is a detailed schematic of the intelligent mechanical linkage performance system as it relates to the first exemplary embodiment in FIG. 1.

FIG. 2 details a schematic of the boom assembly 110 of a skidder 200 as it relates to the controller 205 of the skidder in the intelligent mechanical linkage performance system 300 (also detailed in FIG. 9). As previously noted, the boom assembly 110 includes an arch section 230 (i.e. the first section 112 of the boom assembly 110) coupled to the rear vehicle frame 220, a boom section 240 (the second section 114 of the boom assembly 110) coupled to the arch section 230, and a grapple 207 (the implement 105). A proximal end 256 of the arch section 230 is pivotably coupled to the rear vehicle frame 220 and a distal end 258 of the arch section 230 is pivotably coupled to the boom section 240. In this particular embodiment, one or more arch hydraulic cylinders 260 are controllable by the operator to move the arch section 230. A proximal portion 266 of the boom section 240 is pivotably coupled to the arch section 230 and a distal portion 268 of the boom section 240 is pivotably coupled to the grapple 207. One or more boom hydraulic cylinder(s) 242 are coupled to the proximal portion 266 of the boom section 240 and are controllable by the operator to move the boom section 240. A proximal portion 276 of the grapple 107 is coupled to the distal portion 268 of the boom section 240. The complete motion, or full extension and retraction, of the arch hydraulic cylinder(s) 260, and the boom hydraulic cylinder(s) 242 forms the envelope of movement 400 (described in detail below) for the grapple 207, wherein the grapple 207 collects a payload 140 such as logs.

The skidder 200 may further comprise a load measuring device(s) (280*a*, 280*b*, may be collectively referred herein to as 280) coupled to the boom assembly 110, wherein the load measuring device (280*a*, 280*b*) are configured to generate load signal(s) 288 indicative of a payload 140. Although the present disclosure indicates two locations for load measuring devices, the load measuring devices 280 comprises a first load measuring sensor 280*a* and a second load measuring sensor 280*b*. The first load measuring sensor 280*a* may comprise of one more sensors mounted at or near the grapple box to cross head rotary joint 158. The second load measuring sensor 280*b* may be mounted at the location where the boom section 240 is coupled to the arch section 230. The actual boom section lift and arch section pull load required are measured using load measuring sensor(s) 280*a* and load measuring sensor(s) 280*b*, respectively. The load signal(s) 288 are received by controller 205 creating an actual load measurement data log module 285 including real-time data wherein the database populates the schematic representations of the envelope of movement 400 with nodes 610 indicating loads at respective positions (shown in FIGS. 6A-6B) by extrapolating from a theoretical performance data module 293.

The work machine, or skidder 200 may further comprise a pin 215, wherein the pin 215 is located at a distal portion of the boom section 268. The pin 215 may comprise a point representing the coupling of the grapple 207 with the distal portion of the boom section 268, that may include the crosshead rotary joint 158. Alternatively, the pin 215 may comprise a central portion of the crosshead rotary joint. During calculations of load anywhere in the envelope of movement 400 by the controller 205, pin 215 represents the payload (i.e. the gravitational pull of load on the distal portion of the boom section 268). The controller 205 may use the measured/known load value and the known relative positions of the boom hydraulic cylinder(s) 242 and the arch hydraulic cylinder(s) 260 to extrapolate the relative load lift force required by boom hydraulic cylinder 242 and pull force required by the arch hydraulic cylinder 260 to move to the next position in the envelope of movement 400.

Figure 3:
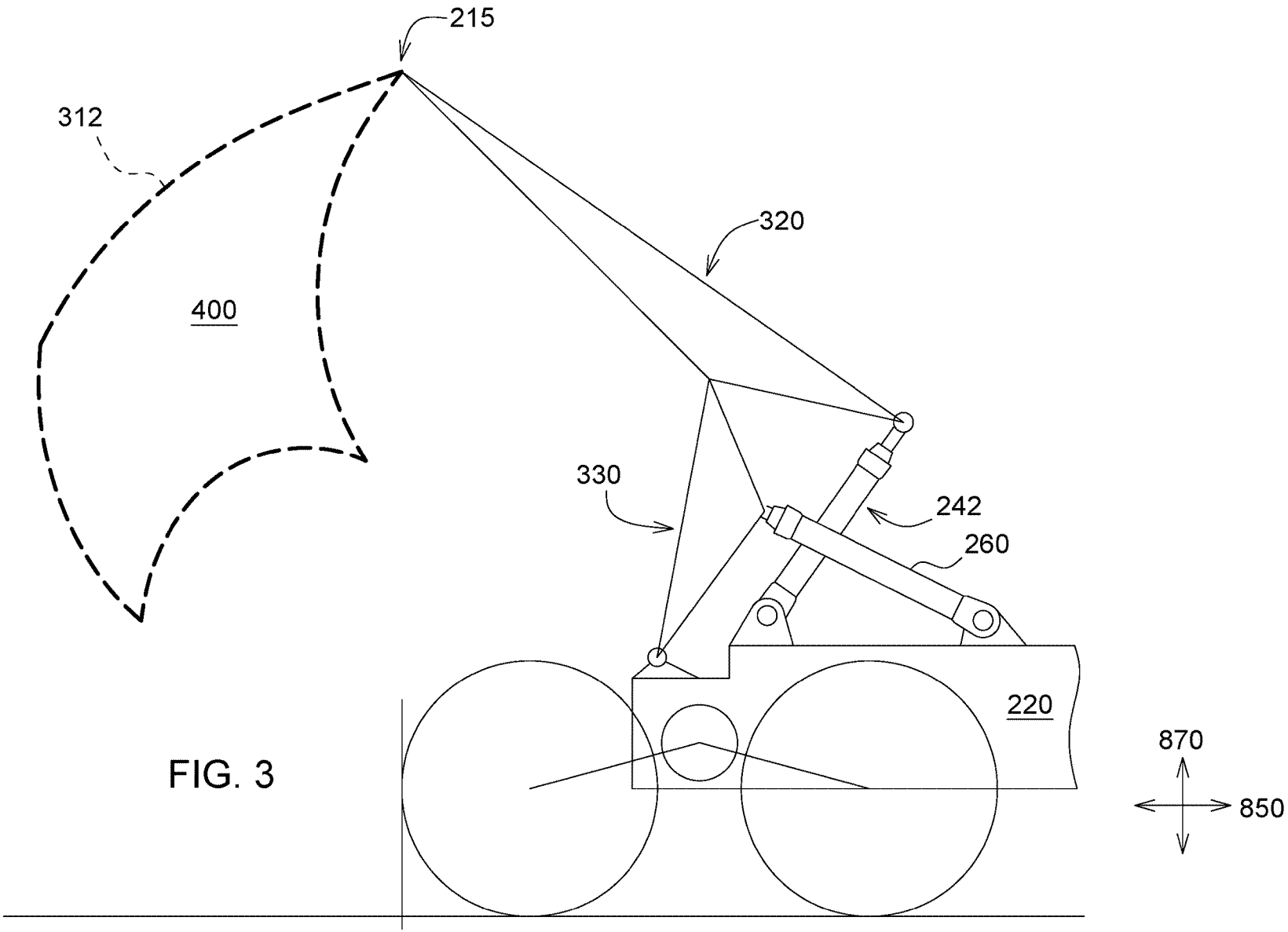
FIG. 3 illustrates a line schematic of the first exemplary embodiment shown in FIG. 1 wherein the envelope of movement is shown.

FIG. 3 illustrates a line schematic of the skidder 200 wherein the envelope of movement 400 is defined by a range of possible movement of the pin 215. The position of the pin 215 is defined by the lengths of the arch hydraulic cylinder (s) 260 and the boom hydraulic cylinder(s) 242. Movement of the arch hydraulic cylinders 260 and the boom hydraulic cylinder 242 combined define the position of the pin 215. The perimeter 312 of the envelope of movement 400 drawn by pin 215 is defined by one or more of the arch hydraulic cylinder(s) 260 and the boom hydraulic cylinder 242 being at a fully extended or retracted position. A perimeter of the arch hydraulic cylinder movement is shown by a first triangular configuration 330 as defined by the mechanical linkage of the boom assembly 110 (shown in FIG. 1). The first triangular configuration 330 is drawn by a point on the distal portion of arch hydraulic cylinder(s) 260 wherein the arch hydraulic cylinder(s) 260 are rotating between full extension and full retraction and the boom hydraulic cylinders 242 are rotating between full extension and full retraction. A perimeter of the boom hydraulic cylinder movement is shown by a second triangular configuration 320 as defined by the mechanical linkage of the boom assembly 110 with the boom hydraulic cylinder(s) 242 rotating between full extension and full retraction and the arch hydraulic cylinders 260 are rotating between full extension and full retraction.

Figure 4:
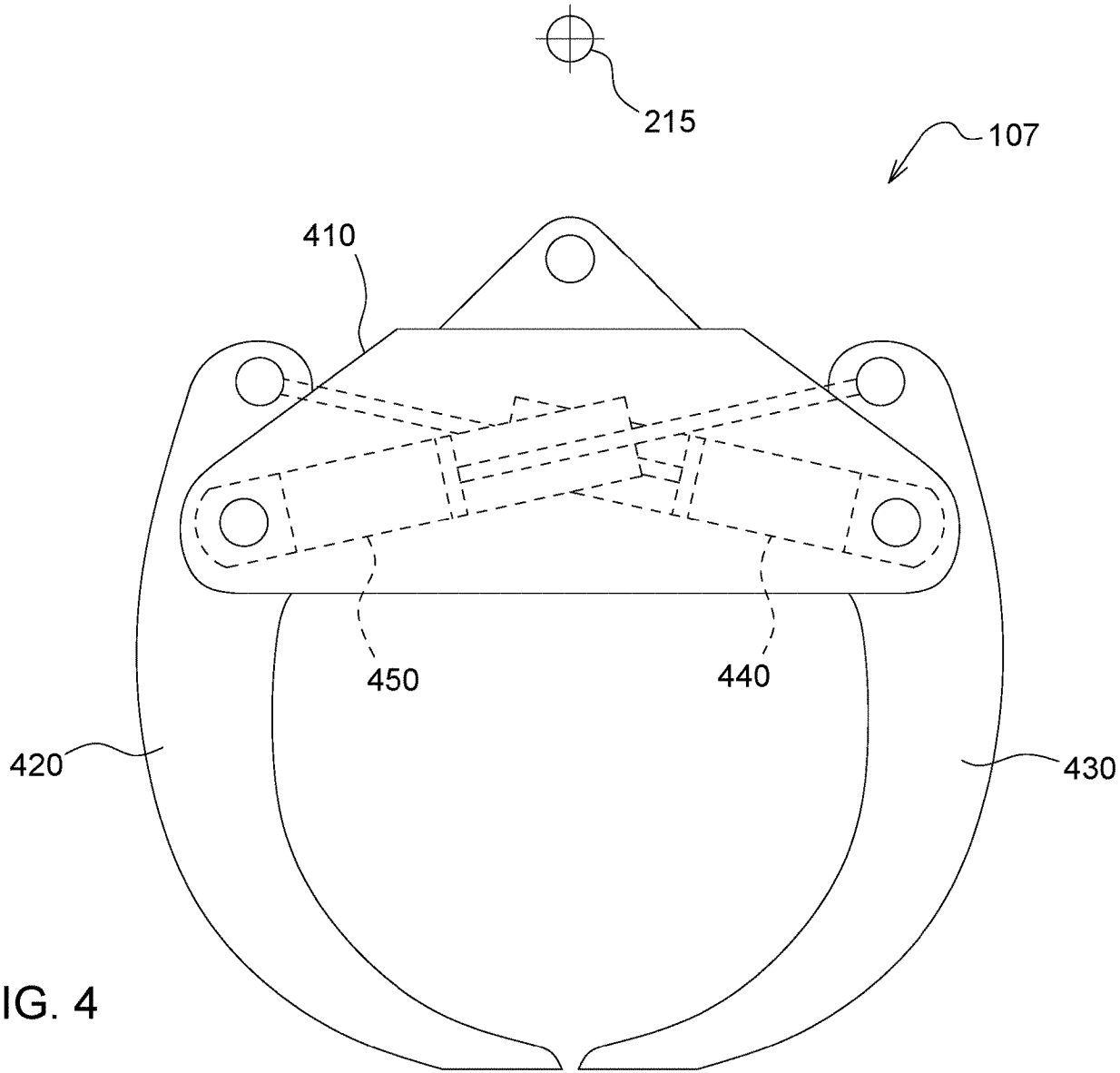
FIG. 4 illustrates a detailed view of a grapple of the first exemplary embodiment shown in FIG. 1.

Now turning to FIG. 4, a detailed exemplary embodiment of the grapple 107 is shown. The grapple 107 may include a base 410, left and right tongs 420, 430, and left and right hydraulic cylinders 440, 450. The base 410 is coupled to the distal portion of the boom section 268. The proximal ends of the left and rights tongs 420,430 are controllable by the left and right hydraulic cylinders 440,450 to open and close the grapple 207. The left hydraulic cylinder 440 has a head end coupled to the base 410, and a piston end coupled to the proximal end of the left tong 420. The right hydraulic cylinder 450 has a head end coupled to the base 410, and a piston end coupled to the proximal end of the right tong 430. The operator can control extension and retraction of the left and right hydraulic cylinders 440, 450 to open and close the grapple 107. When the left and right hydraulic cylinders 440, 450 are retracted, the proximal ends of the left and right tongs 420, 430 are brought closer together, which pulls apart the distal ends of the left and right tongs 420, 430 which opens the grapple 107. When the left and right hydraulic cylinders 440, 450 are extended, the proximal ends of the left and right tongs 420, 430 are pushed apart, which brings together the distal ends of the left and right tongs 420, 430 which closes the grapple 207. The operator can retract the left and right tongs 420, 430 to open the grapple 207 to surround a payload 140 (e.g. trees or other woody vegetation), and then extend the left and right tong cylinders 440, 450 to close the grapple 207 to grab, hold and lift the payload so the machine can move it to another desired location. The pin 215 may be located directly above the base 410 of the grapple 207 (designated by a cross 215 in FIG. 4).

Figure 5:
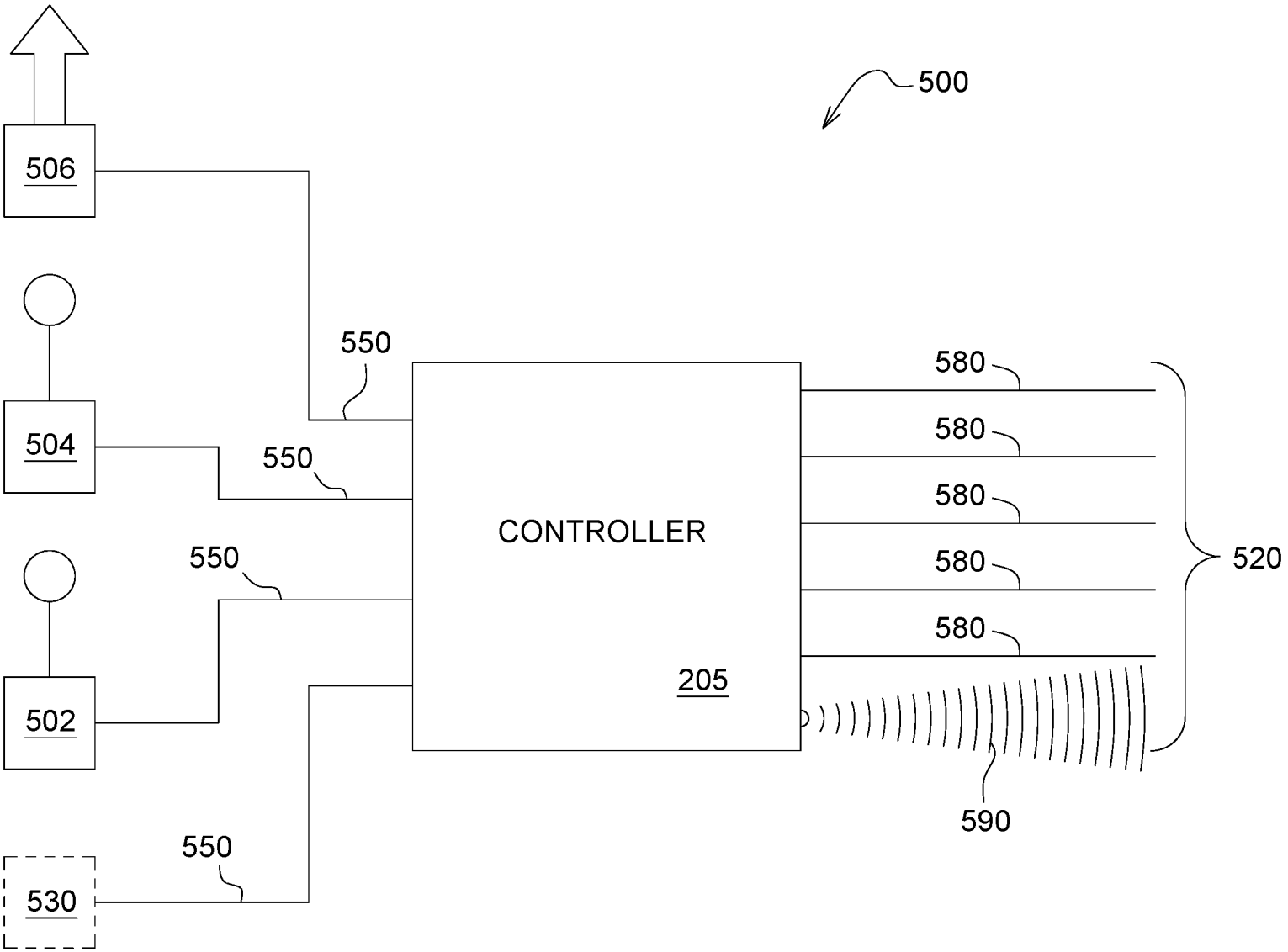
FIG. 5 illustrates some operator controls for the first exemplary embodiment shown in FIG. 1.

FIG. 5 illustrates a schematic example of the user input interface 500 from the operator's station for the arch hydraulic cylinders 260, boom hydraulic cylinders 242, and tong hydraulic cylinders (440, 450). In this first exemplary embodiment, the user input interface 500 may comprise discrete control members for boom control 502, arch control 504 and a grapple control 506. Discrete may be interpreted as an individual control member or movement of a control member in one direction yield movement of a first actuator 131 and movement of the control member in a different direction yields movement in a second actuator 136. The boom control 502 allows an operator to regulate extension and retraction of the boom hydraulic cylinders 242 to move the boom section 240 relative to the arch section 230. The arch control 504 controls extension and retraction of the arch hydraulic cylinder(s) 260 to lower and raise the arch section 230 relative to rear vehicle frame 220. The grapple control 506 controls extension and retraction of the tong hydraulic cylinders (440, 450) to open and close the grapple 207. The boom control 502, arch control 504, and grapple control 506 send user input signals 550 to the controller 205 and the controller sends command signals 580 to control the boom, arch, and tong hydraulic cylinders (260, 242, 440, 450) over control lines 520 (note commands may also be communicated wirelessly 590). The user input interface 500 may further comprise a performance display graphics module 530 (which may also simply be referred to a display) as described in further detail below.

Now returning to FIG. 2 with continued reference to FIG. 1, the controller 205 of the skidder 200 (work machine 100) is configured to receive a first position signal 236 (indicative of the position and angle of the arch section 230) from the first boom position sensor 132, a second position signal 238 (indicative of the position and angle of the boom section 240) from the second boom position sensor 138, and the load signal 288 (indicative of the payload) from the load measuring device 280. In this embodiment, the first boom position sensor 232 and the second boom position sensor 138 may comprise of one or more position sensors as exemplified in FIG. 2. Furthermore, the first boom position sensor 132 and the second boom position sensor position sensors 138 may further be coupled to their respective actuators (131, 136) wherein the position sensors allow for the controller 205 to determine the hydraulic capacities or alternatively load lift/pulling capability of each respective actuator (131, 131). The controller 205 comprises an actual load measurement data log module 285 to receive the load signal(s) 288 from the load measuring device(s) 280 and a position/angle data processor 290 to receive the first position signal(s) 236 and the second position signal(s) 238. Each type of signal (288, 236, 238) may be received in real-time creating a data log. The position/angle data processor 290 may use the known linkage geometry to calculate the respective position of pin 215 in the envelope of movement 400.

Figure 6B:
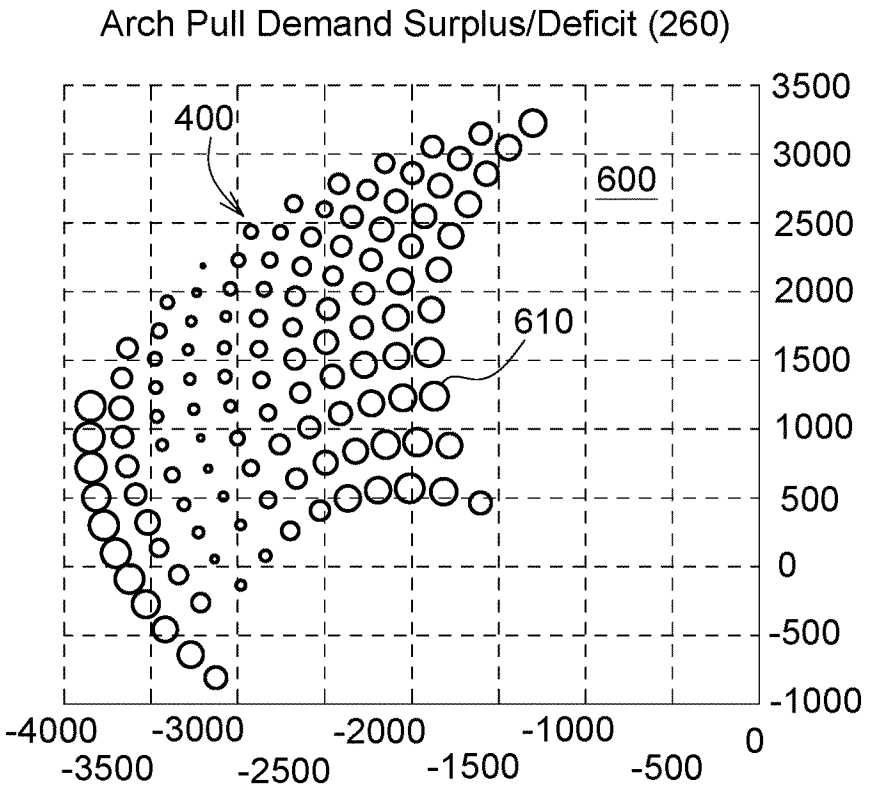
FIG. 6B is one embodiment of a map of hydraulic capacities within an envelope of movement for the arch hydraulic cylinder(s) of the embodiment shown in FIG. 1.
Figure 6A:
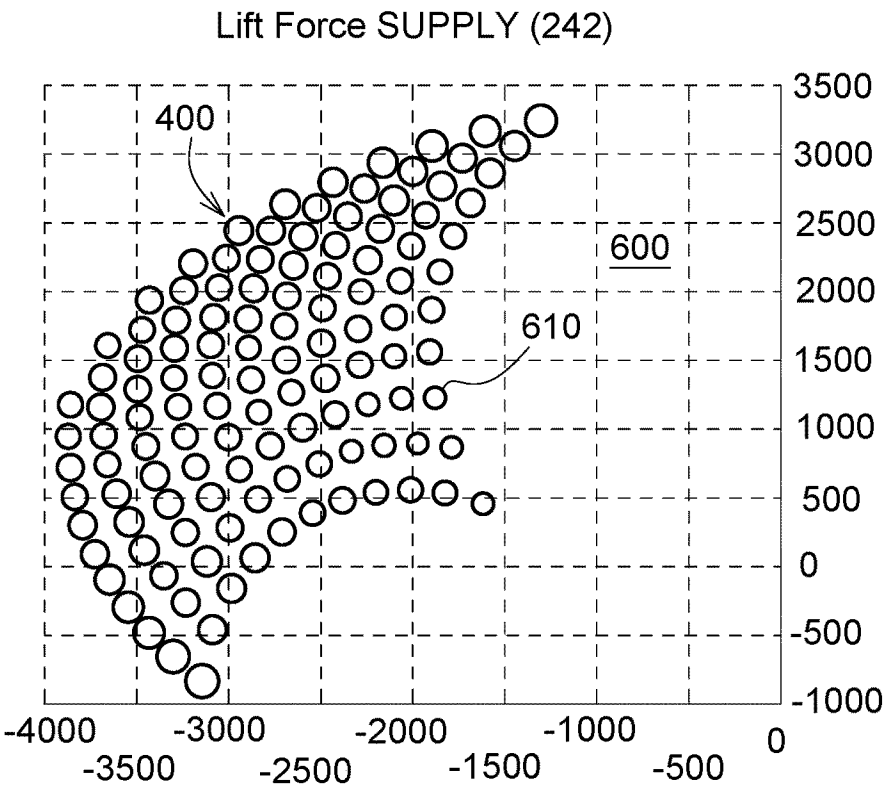
FIG. 6A is one embodiment of a map of hydraulic capacities within an envelope of movement for the boom hydraulic cylinder(s) of the embodiment shown in FIG. 1.

Now turning to FIGS. 6A, and 6B, the controller 205 is further configured to calculate a map of hydraulic capacities 600 within an envelope of movement 400 for one or more of the first and the second actuators (131, 136) based on the first position signal 236, the second position signal 238, and the load signal 288, and generate a lift path 710 for actuating each respective hydraulic cylinder within the envelope of movement 400 (shown in FIGS. 7A and 7B as dotted lines) of movement of the pin 215 through at least a portion of the envelope 400 based on the hydraulic capacities, wherein the available hydraulic capacity for lifting and pulling the payload 140 within the envelope of movement 400 is smaller than the envelope of movement without a payload 140. The map of hydraulic capacities 600 may be communicated to the operator on a performance display graphics module 530 on an operator device such as a screen in the operator cab, or a or an alternative device such as a tablet, mobile electronic, phone, a windshield screen overlay, and a remote operator station, to name a few. An alternative or supplemental option may be haptic feedback to the operator through the respective control member requiring movement for optimized control. Both usage of the performance display graphics module 530 and haptic feedback may advantageously provide guidance and a training opportunity for the operator. Because boom control member 502 and the arch control member 504 are distinct and separate in a grapple skidder 200, it becomes simple to implement haptic feedback.

The map of hydraulic capacities 600 comprises a series of nodes 610 (only one of several is indicated) representing the hydraulic capacities of one or more of the first and the second actuators (131, 136) throughout the envelope of movement 400 in real-time. FIG. 6A represents the hydraulic capacity of the boom hydraulic cylinder(s) 242 throughout the envelope of movement 400 through a series of nodes 610, or the boom lift capacity (i.e. the boom lift force capacity or deficit represented by a positive or negative number) throughout the envelope of movement 400 in real-time. The x-axis and the y-axis represent relative positions to frame 135 (i.e. based on the current position of the other respective actuators on the boom assembly 110). FIG. 6B represents the hydraulic capacity of the arch hydraulic cylinder(s) 260 (i.e. the arch pull capacity or deficit throughout the envelope of movement 400) in real-time (i.e. based on the current position of the other respective actuators on the boom assembly 110). Because movement of the boom hydraulic cylinder(s) 242 and the arch hydraulic cylinders 260 are controlled through individual control members (502 and 504 respectively) from the user input interface 500, commanding movement of the hydraulic cylinders (242, 260) may easily be interpreted from the map of hydraulic capacities 600 presented in FIGS. 6A and 6B. The capacity or deficit may be designated by a positive number or negative number indicated numerically at each node 610, and/or through a physical representation wherein the magnitude or size of each respective node 610 (e.g. a circle shown in this exemplary embodiment) indicates the magnitude of hydraulic capacity remaining based on the current actuator positions. For example, a small node may indicate little or no hydraulic capacity within the envelope of movement 400 at the respective location. Whereas, a large node may indicate ample capacity at the respective position. The current position of a pin 215 within the envelope of movement 400 may also be designated by a node of different color or symbol such that the operator may track its position in real-time. A series of nodes 610 located adjacent to one another with sufficient capacity in the envelope of movement 400 may indicate an optimal and/or safe pathway of movement (also referred to as lift path 710 in FIGS. 7A and 7B) of the pin 215. In an alternative embodiment, only nodes 610 with capacity may be designated by graphical representations at the nodes 610. In the embodiment shown in FIGS. 6A and 6B, the nodes 610 may fluctuate in values real-time as a hydraulic cylinder (242 or 260) moves through the envelope of movement 400. For example, if the operator manipulates movement of the boom hydraulic cylinders 242 to provide a lift force for payload 140 shown in FIG. 6A, the hydraulic capacities of the arch hydraulic cylinders 260 in FIG. 6B will re-populate each node 610 based on the new data (position). Although FIGS. 6A and 6B demonstrate an exemplary number of nodes 610 within the envelope of movement 400 for a grapple skidder 200, the number of nodes 610 may be modified based on the granularity of detail desired. On another note, the units along the x-axis and the y-axis may also be manipulated depending on payload 140 or country of operation. In the present embodiment, hydraulic capacity along the x-axis and y-axis is shown in kilonewtons.

Figure 7B:
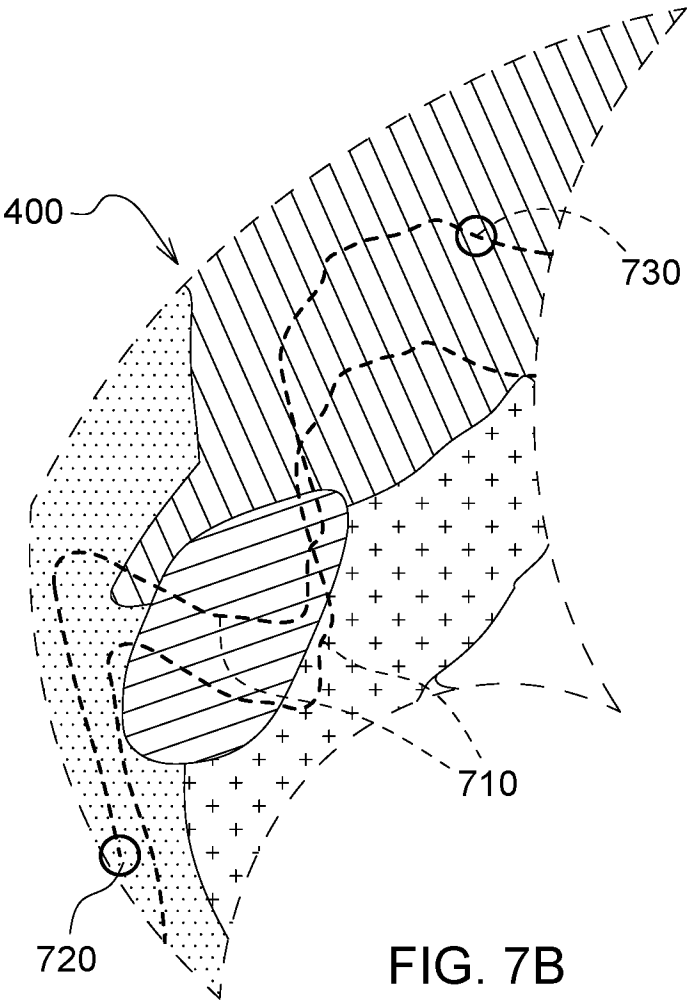
FIG. 7B one embodiment of a map of hydraulic capacities within an envelope of movement for the arch hydraulic cylinder(s) including a lift path of the embodiment shown in FIG. 1.
Figure 7A:
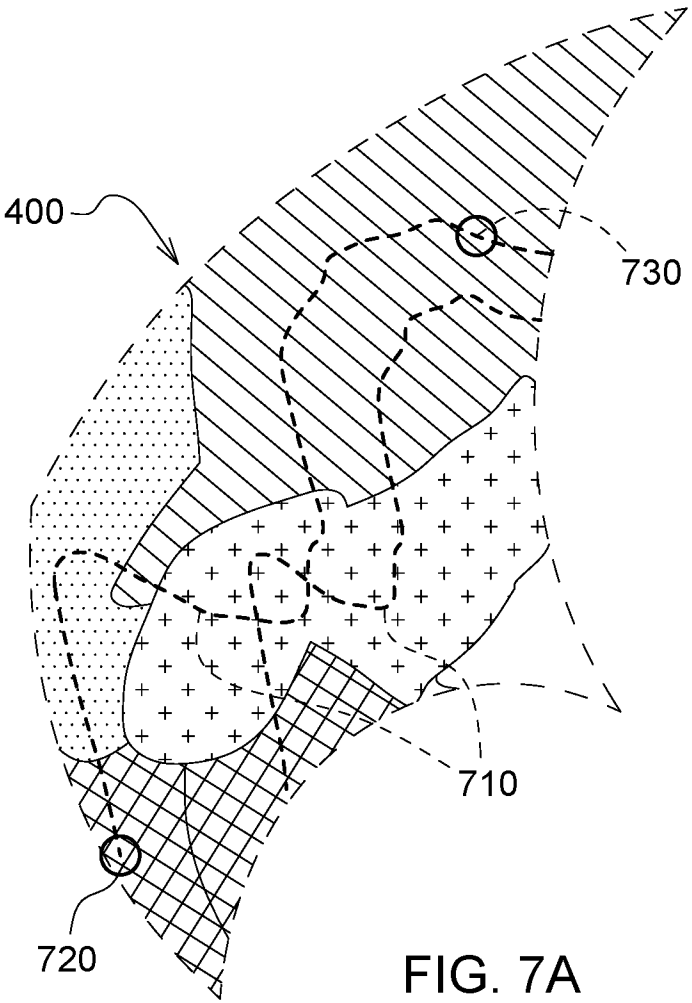
FIG. 7A is one embodiment of a map of hydraulic capacities within an envelope of movement for the boom hydraulic cylinder(s) including a lift path of the embodiment shown in FIG. 1.

Now turning to FIGS. 7A and 7B, the schematic shown comprises an envelope of movement 400 including a lift path 710 (designated by the dotted line) of the pin 215 from a first position 720 to a second position 730 through nodes 610 with sufficient hydraulic capacity to carry respective payload 140 that may be measured by the load measuring device 280. Note that more than one lift path 710 may be shown simultaneously as exemplified in the embodiment shown.

The envelope of movement 400 shown in FIGS. 7A and 7B may be further enhanced when on display on a graphical user input interface wherein portions of the envelopment of movement 400 are color-coded, or pattern-coded. The color-code is based on the degree of hydraulic capacity for the respective hydraulic cylinder the envelope of movement 400 is associated with, when the pin 215 is positioned at the location designated within the envelope of movement 400. In one embodiment of the envelope of movement 400, the color green may indicate a hydraulic capacity beyond 20%, the color red may indicate a deficit of hydraulic capacity; the color yellow may indicate a capacity between 0% and 5%; and the color purple may indicate a capacity between 5% and 20%, for moving payload 140. Note, hydraulic capacity may also correlate to the amount of travel a pistol portion may have remaining in the cylinder of a hydraulic cylinder. The lift path 710 indicates an optimized trajectory for movement of the pin 215 from a first position 720 to a second position 730 through a series of nodes 610 with sufficient hydraulic capacity for the respective actuator 120. In the embodiment of a grapple skidder 200, the first position 720 indicates the current position of pin 215, and the second position 730 may indicate the desired final position, for example a transport position wherein a payload 140 is sufficiently lifted above ground in preparation for transport. The user input interface 500 may allow the operator to toggle between the map of hydraulic capacities with nodes 610, and the map of hydraulic capacities with a suggested lift path 710 (with or without color-coding).

Returning to FIGS. 1 and 2, and also now referring to FIGS. 8 and 9, the controller 205 of the work machine 100 may further receive an inclination signal 295 from an inclination sensor 160 coupled to the work machine 100 when calculating the map of hydraulic capacities 600 (shown in FIG. 6). FIG. 8 depicts a line schematic of the work machine 100, a grapple skidder 200, on an inclined surface 810. The inclination sensor 160 may determine the inclination of the horizontal-longitudinal axis 850 of the work machine 100 relative to the ground (shown as a) and the controller 205 may modify the load signal(s) 288 based on this inclination signal 295. In other words, the inclination is the vector 820 representing the payload 140 from a point located at or near pin 215 relative to frame 130 when accounting for directional change in gravitational pull because of the incline angle $\alpha$. That is, in a steep slope condition, the controller 205 will populate the envelope of movement 400 with hydraulic capacities while taking into consideration the directional pull of the payload as it affected by gravity, with respect to the directional pull on the actuators 120 as seen in FIG. 8. Vector 805 represents a first directional pull of load 140 if work machine were located on a flat ground surface. Vector 820 represents a second directional pull of payload 140 with work machine located on the inclined surface 810. The incline angle $\alpha$ is equivalent to the change in the relative angle of the payload 140.

FIG. 9 depicts a detailed schematic of the intelligent mechanical linkage performance system 300 as it relates to the first exemplary embodiment shown in FIG. 1. More specifically, the intelligent mechanical linkage performance system 300 as applied to the grapple skidder 200 is illustrated. In one non-limiting example, the intelligent mechanical linkage performance system 300 comprises a first boom position sensor 132 coupled with the first section of the boom assembly 110 of the work machine 100 for generating a first position signal 236 indicative of a position of the first actuator 131. The intelligent mechanical linkage performance system 300 comprises of a second boom position sensor 138 coupled with a second section of the boom assembly 114 of the work machine 100 for generating a second position signal 238 indicative of a position of the second actuator 136. The first position signal 236 and the second position signal 238 are received by a position/angle data processor 290 which may be located on the controller 205 to determine the relative positions and/or angles of the first section of the boom assembly 110, the second section of the boom assembly 114, and ultimately the pin 215 to frame 130.

A load measuring device 280 is coupled to the boom assembly 110 wherein the load measuring device 280 is configured to generate a load signal 288 indicative of the payload 140, wherein the load signal 288 is received by the controller 205. The intelligent mechanical linkage performance system 300 further comprises the pin 215 (mentioned above) coupled to the second section of the boom assembly 114 at a location distal form the first section of the boom assembly 110, wherein movement of the pin 215 creates an envelope of movement 400 throughout which the pin 215 is moveable by the first section 112 and the second section 114. An implement 105 may be coupled to the pin wherein the implement is configured to engage the payload. As previously mentioned the perimeter 312 of the envelope of movement 400 is determined by one or more hydraulic cylinders 125 coupled to the boom assembly 110 being at a fully extended or retracted position. That is the perimeter 312 is determined by the full range of possible movement with each actuator 120 extended or retracted given the linkage geometry of the work machine 100. The intelligent mechanical linkage performance system 300 further comprises a controller 205 coupled to the work machine 100 wherein the controller is configured to receive a first position signal 238 from the first boom position sensor 138; receive a second position signal 238 from the second arch position sensor 136; and receive the load signal 288. The controller 205 comprises an actual load measurement data log module 285, a theoretical performance data module 293, and a performance display graphics module 530. The position/angle data processor 290 receives the position signals (236, 238) in real-time from the first boom position sensor 132 and the second arch position sensor 138, and the load signals 288 in real-time. The controller 205 upon receiving this information, identifies the node 610 in the envelope of movement 400 wherein the pin 215 is located. The controller 205 then analyzes and optimizes the first section 112 (arch pull of grapple skidder) and the second section 114 (boom lift of grapple skidder) force requirements throughout the geometry of the envelope of movement 400 based on the load signals 288 and the first and second position signals (236, 238), by correlating the identified node 660 (i.e. node representing current position) within the envelope of movement 400 to the theoretical data performance module 293. The theoretical performance data module 293 may comprise of theoretical load capacities throughout the envelope of movement 400 and is a prepopulated with hydraulic capacities of each respective hydraulic actuator for each respective node within the envelope of movement 400 given a pre-identified payload (e.g. the payload could be zero or some other minimum load). Once the node 610 is identified, the controller 205 then extrapolates from the theoretical performance data module 293 knowing the ratio between the identified node 660 and corresponding node in the theoretical performance data module 293, and populates the remaining envelope of movement 400, calculating a map of hydraulic capacities for either or both the first actuator and the second actuator based on the payload 140. Note that the load signal 288 may fluctuate at any given time because a portion of the payload 140 may drag on the ground because a grapple skidder 200 generally moves tall felled trees. As seen in FIGS. 6A and 6B, the map of hydraulic capacities throughout the envelope of movement comprises a series of nodes demonstrating the available load supply from the hydraulic system of the work machine for each respective actuator. This can be designated by a positive number (shown as +) as in an available supply, or a negative number (shown as −) as in a deficit of force (i.e. insufficient force to pull the payload 140 from the current position (note the current position may also be the identified node 660) to a second position, wherein the second position is generally identified as the transport position).

Additionally, the operator may toggle the intelligent mechanical linkage performance system 300 between automatic mode 375 and semi-automatic mode 365. In automode, the controller 205 may be configured to inhibit movement of the pin 215 to a plurality of nodes 610 within the envelope of movement 400 where there is insufficient hydraulic capacity for moving payload 140. Furthermore, in automatic mode 375, the controller may automatically move the boom assembly following the calculated lift path 710 as designated by the dotted lines seen in FIGS. 7A and 7B (for example), as the operator follows movement on the performance display graphics module 530. The lift path 710 can change in real-time as pin 215 moves. This may be because of how the payload engages 140 the ground surface or the inclined surface 810 of the ground surface, to name a few. Alternatively, in semi-automatic mode 365 the display shows the real-time envelope of movement 400, visually-coded (color or patterns) to communicate to the operator the available load supply from the hydraulic system based on the payload 140 for each node 610 throughout the envelope of movement 400. The operator may then use the user input interface 500 to maneuver pin 215 and ultimately the payload 140 to a transport position using the suggested lift path 710 as a guide. Furthermore, in semi-automatic mode 365 the controller may further provide haptic feedback to the operator as a guide (e.g. a vibration of the control member requiring movement).

FIG. 10 is a side view of a second exemplary embodiment of a work machine 100 having an intelligent mechanical linkage performance system 300. The work machine 100 is embodied as an excavator 900 including an upper frame 910 pivotally mounted to an undercarriage 915. The upper frame 910 can be pivotally mounted on the undercarriage 915 by means of a swing pivot. The undercarriage 915 can include a pair of ground engaging tracks 920 on opposite sides of the undercarriages 915 for moving along the ground surface. The upper frame 910 includes an operator cab in which the operator controls the excavator 900. The operator may actuate one or more controls of the controller 205 for purposes of operating the excavator 900. These controls may include a steering wheel, control levers, controls pedals, control buttons, and a graphical user input interface with display. The excavator 900 includes a boom assembly 110 comprising a large boom 925 (first section of the boom assembly 112) that extends from the upper frame 910 (frame 130) adjacent to the operator cab 226 and a dipper stick 935 (second section of the boom assembly 114). The large boom 925 is rotatable about a vertical arc relative the upper frame 910 by actuating large boom hydraulic cylinder(s) 930 (first actuator). The dipper stick 935 is coupled to the large boom 925 and is pivotable relative to the large boom 925 by means of a dipper stick hydraulic cylinder 940 (second actuator). Coupled to the end of the dipper stick 935 is an implement 105 (shown as a bucket 905) wherein the implement 105 is pivotable relative to the dipper stick 935 by an implement hydraulic cylinder 945.

Figure 11:
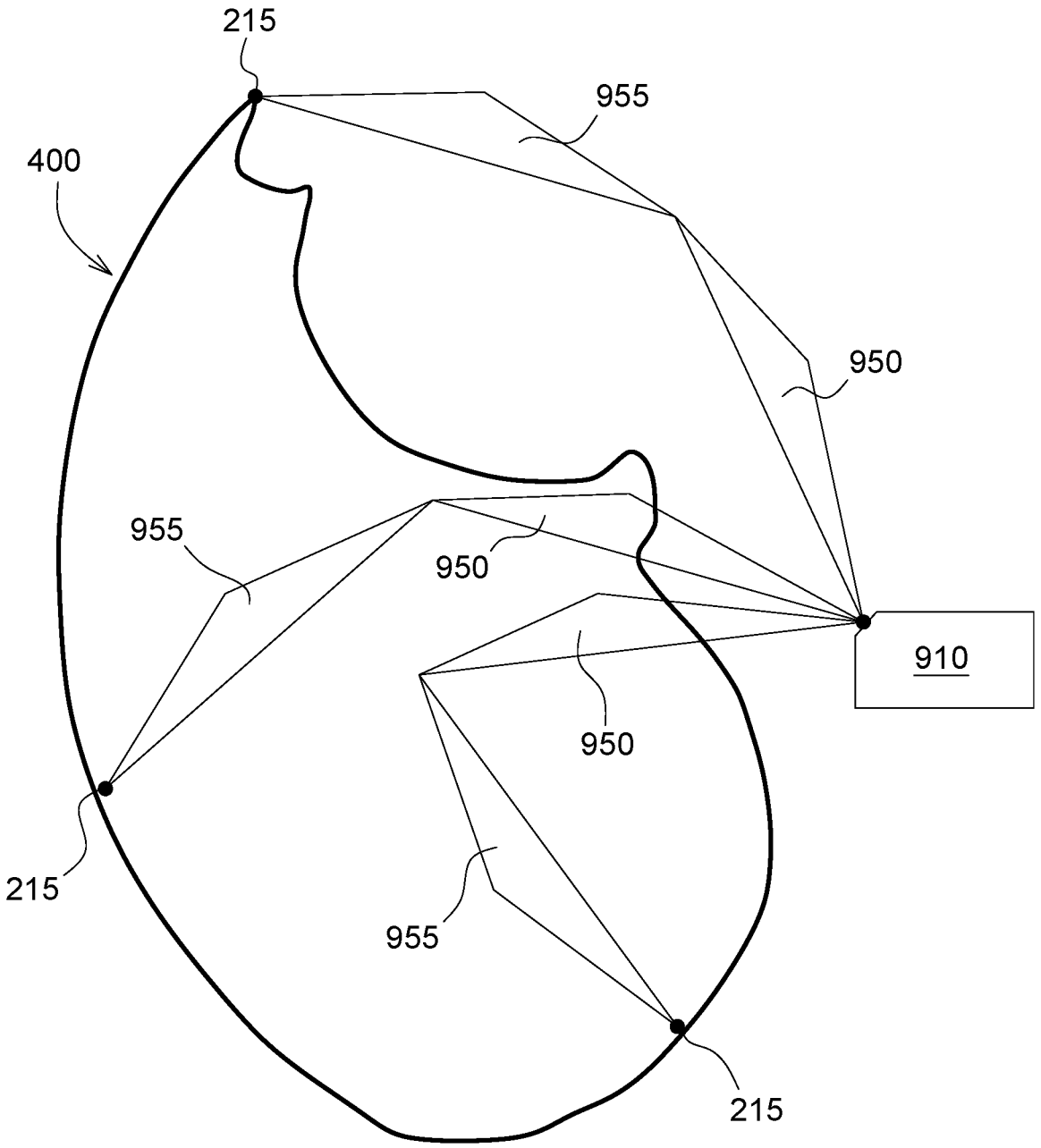
FIG. 11 is a line schematic of the second exemplary embodiment shown in FIG. 10 wherein the envelope of movement is shown.

FIG. 11 is a line schematic of the second exemplary embodiment shown in FIG. 10 wherein the envelope of movement 400 for an excavator 900 is shown. The envelope of movement 400 is defined by a range of possible movement of pin 215. The position of pin 215 is defined by the lengths of the large boom hydraulic cylinders and the dipper stick hydraulic cylinder(s) 940. The perimeter (as designated by the solid black line) of the envelope of movement 400 drawn by pin 215 is defined by one or more of the large boom hydraulic cylinder(s) 930 and the dipper stick hydraulic cylinder(s) 940 being at a fully extended or retracted position. A perimeter of the large boom hydraulic cylinder movement is shown by a series of first geometric configurations 950 as defined by the mechanical linkage of the boom assembly 110 (shown in FIG. 10). The first geometric configuration 950 is drawn by a point on the distal portion of the large boom hydraulic cylinder(s) 930 wherein the large boom hydraulic cylinder(s) 930 are rotating between full extension and full retraction and the dipper stick hydraulic cylinder(s) 940 are rotating between full extension and full retraction. A perimeter of the dipper stick hydraulic cylinder movement is shown by a series of second triangular configurations 955 as defined by the mechanical linkage of the boom assembly 110 with the large boom hydraulic cylinder(s) 930 rotating between full extension and full retraction and the dipper stick hydraulic cylinders 940 are rotating between full extension and full retraction.

Figure 12:
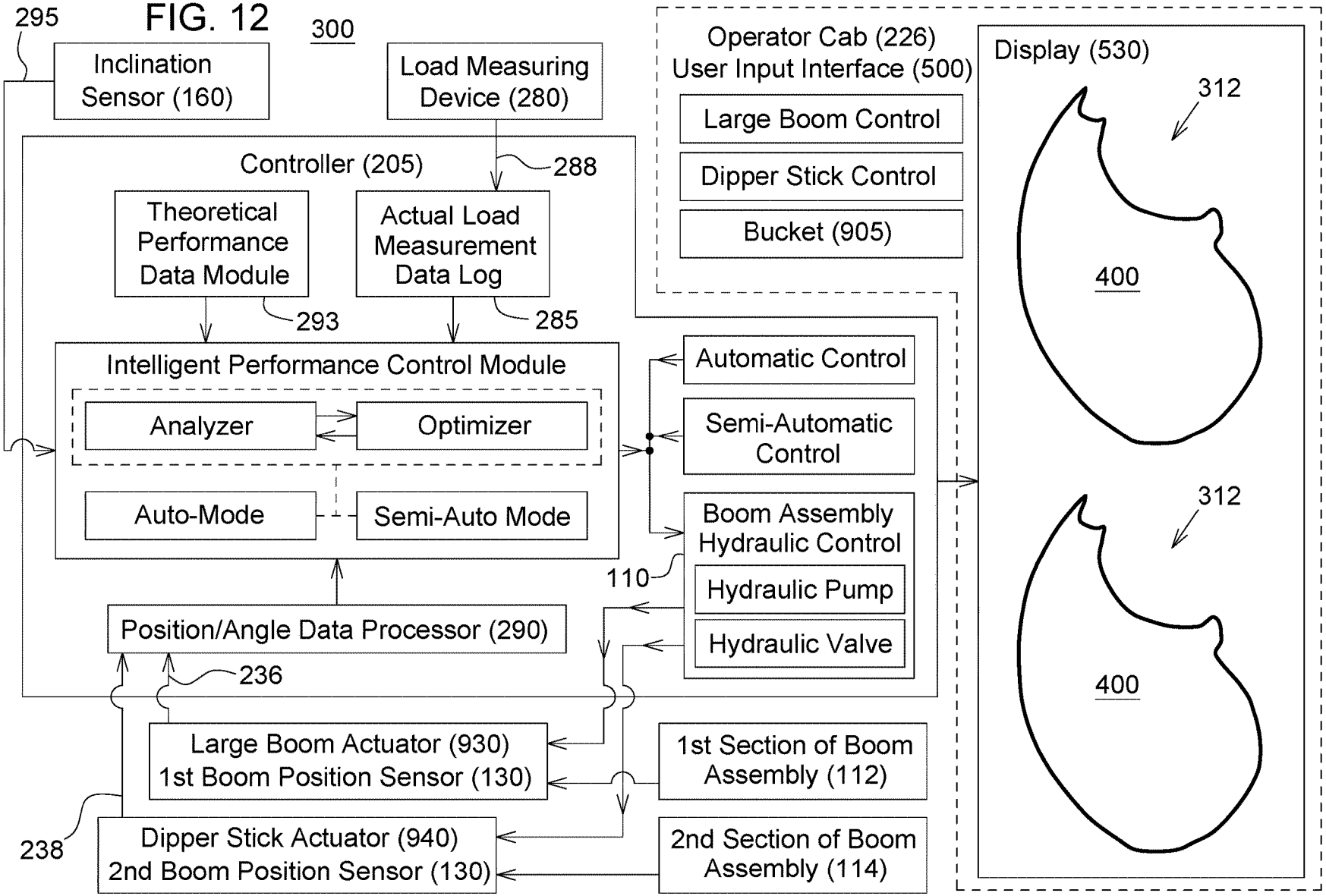
FIG. 12 is a detailed schematic of the intelligent mechanical linkage performance system as it relates to the second exemplary embodiment in FIG. 10.

FIG. 12 is a detailed schematic of the intelligent mechanical linkage performance system 300 as it relates to the second exemplary embodiment, an excavator 900, as shown in FIG. 10. The system is similar to the intelligent mechanical linkage performance system 300 shown in FIG. 9 with the exception of the descriptive inputs of the user input interface 500 (i.e. large boom 925 control, dipper stick 935 control, and bucket 905 control), and outputs on a performance display graphics module 530 (i.e. the envelope of movement 400 and relevant data calculated reflects the configuration of the excavator 900 as discussed in FIG. 11). Because the actuator 120 lengths and linkage geometry are different, the envelope of movement 400 will be different. However, the system and method optimizing the performance may be the same. Additionally, the controller may be further configured to identify a payload center of mass 380. The payload center of mass 380 may be based on a third position signal received from a third actuator 945 wherein the implement 105 is moveable by the third actuator 945. The controller 205 modifies the load signal 288 based on the payload center of mass 380.

Figure 13:
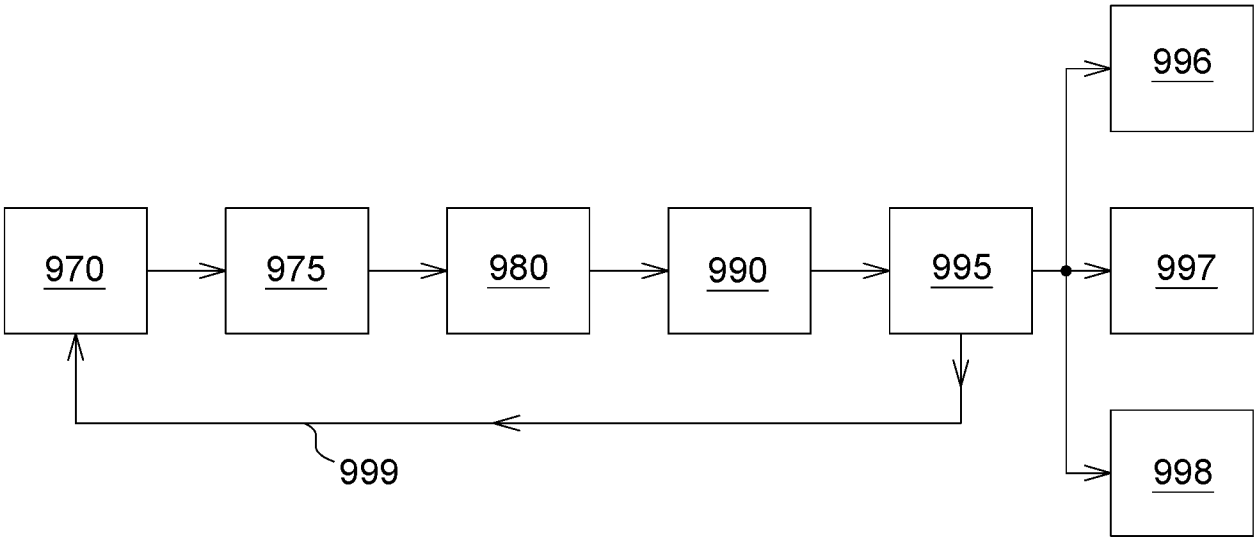
FIG. 13 is a method related to the intelligent mechanical linkage performance system.

FIG. 13 is a method of a control system for a boom assembly 110 of a work machine 100 to intelligently control the boom assembly during a payload 140 moving operation. In a first block 970, a first actuator sensing system 132 coupled with a first section of the boom assembly 112 of the work machine 100 generates a first position signal 236 indicative of the position of the first actuator 131; a second actuator sensing system 138 coupled with the second section of the boom assembly 114 generates a second position signal 238 indicative of the position of the second actuator 136; and a load measuring device 280 generates a load signal 288 indicative of payload 140. In a second block 975, the controller 205 receives these signals (i.e. the first position signal 236, the second position signal 238, load signal 288). In a third block 980, the receipt of the first and second position signals (236, 238) by the position/angle data processor 290 allows the processor to determine current the relative position of pin 215 within the envelope of movement. In a fourth block 990, the intelligent performance control module on the controller 205, analyzes the actual load measurement data log module 285 and utilizes the load signal 288 and determined position of pin 215 within the envelope of movement 400 to populate the remaining envelope of movement by extrapolating from load values in the theoretical performance data module 293. In a fifth block 995, the controller 205 then optimizes lift path 710 (i.e. movement of pin 215 from the current position to a transport position) through a series of positions represented by nodes 610 within the envelope of movement. From a sixth block 996, the controller 205 has the option to create a graphical representation communicated on performance display graphics module 530 or haptic guidance for the operator designating a series of discrete movements for each respective actuator 120 to move to a next position (i.e. generally towards the transport position). At the same time, in block 997, the controller 205 may operate the machine in semi-automatic 365 mode wherein movement to specific nodes 610 within the envelope of movement 400 may be restricted. The operator may have to navigate utilizing the allowed regions within the envelope of movement only. Alternatively, in block 998, the controller 205 may operate in automatic mode 375 wherein the pin 215 moves from a first position 720 to the intended second position 730 (e.g. the transport position) automatically with minimal or no assistance from the operator. Block 995 is continuously updated through loop 999 as the pin 215 moves through the envelope of movement 400. The intelligent mechanical linkage performance system 300 thereby advantageously allows for the machine to update and re-strategize its approach real-time.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

The references "A" and "B" used with reference numerals herein are merely for clarification when describing multiple implementations of an apparatus.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims

What is claimed is:

1. A work machine having an intelligent mechanical linkage performance system, the work machine comprising:

a frame and a ground-engaging mechanism, the ground-engaging mechanism configured to support the frame on a surface;

a boom assembly coupled to the frame wherein the boom assembly comprises a first section pivotally coupled to the frame and moveable relative to the frame by a first actuator, a first boom position sensor coupled to the first section, and a second section pivotally coupled to the first section and moveable relative to the first section by a second actuator, a second boom position sensor coupled to the second section;

a load measuring device coupled to the boom assembly, the load measuring device configured to generate a load signal indicative of a payload;

a pin coupled to the second section at a location distal from the first section, the pin having an envelope of movement throughout which the pin is moveable by the first section and the second section; and a controller configured to receive a first position signal from the first boom position sensor, a second position signal from the second boom position sensor, and the load signal from the load measuring device, wherein the controller is further configured to calculate a map of hydraulic capacities within the envelope of movement for one or more of the first and the second actuators based on the first position signal, the second position signal, and the load signal, and generate a movement envelope of movement of the pin through at least a portion of the envelope based on the hydraulic capacities, the movement envelope being smaller than the envelope.

2. The work machine of claim 1, wherein the pin is coupled to an implement, the implement configured to engage a payload.

3. The work machine of claim 1, wherein the map of hydraulic capacities comprises a series of nodes representing the hydraulic capacities of one or more of the first and the second actuators throughout the envelope in real-time.

4. The work machine of claim 3, wherein the movement envelope comprises a lift path of the pin from a first pin position to a second pin position through nodes with sufficient hydraulic capacity.

5. The work machine of claim 1, wherein the envelope of movement is displayed on a user input interface through a color code, the color code based on a degree of hydraulic capacity.

6. The work machine of claim 1, wherein the load measuring device comprises a first load measuring sensor coupled to the first section, and a second load measuring sensor coupled to the second section.

7. The work machine of claim 1, wherein the controller further receives an inclination signal from an inclination sensor coupled to the work machine when calculating the map of hydraulic capacities, the inclination sensor determining the inclination of the horizontal longitudinal axis of the work machine and the controller modifying the load signal based on the inclination signal.

8. The work machine of claim 1, wherein the controller is configured to inhibit movement of the pin to a plurality of nodes within the envelope of movement, the plurality of nodes having insufficient hydraulic capacity for moving the payload.

9. The intelligent mechanical linkage performance system for a work machine for a payload moving operation, the system comprising:

a first boom position sensor coupled with a first section of a boom assembly of the work machine for generating a first position signal indicative of a position of a first actuator;

a second boom position sensor coupled with a second section of a boom assembly of the work machine for generating a second position signal indicative of a position of a second actuator;

a load measuring device coupled to the boom assembly, the load measuring device configured to generate a load signal indicative of a payload;

a pin coupled to the second section at a location distal from the first section, the pin having an envelope of movement throughout which the pin is moveable by the first section and the second section; the pin coupled to an implement, the implement configured to engage a payload; and a controller configured to receive the first position signal from the first boom position sensor, the second position signal from the second actuating sensing system, and the load signal, calculate a map of hydraulic capacities for one or more of the first and second actuators based on the first position signal, the second position signal, and the load signal, generate a movement envelope of movement of the pin through at least a portion of the envelope of movement based on the hydraulic capacities, the movement envelope being smaller than the envelope of movement.

10. The system of claim 9, wherein the map of hydraulic capacities comprises a series of nodes representing the hydraulic capacities of one or more of the first and the second actuators throughout the envelope in real-time.

11. The system of claim 10, wherein the movement envelope comprises a lift path of the pin from a first pin position to a second pin position through nodes with sufficient hydraulic capacity.

12. The system of claim 9, wherein the envelope is displayed on a user input interface through a color code based on a degree of hydraulic capacity.

13. The system of claim 9, wherein the load measuring device comprises a first load measuring sensor coupled to the first section, and a second load measuring sensor coupled to the second section.

14. The system of claim 9, wherein the system further comprises an inclination sensor coupled to the work machine, the inclination sensor determining the inclination of the horizontal longitudinal axis of the work machine and generating an inclination signal, the controller modifying the load signal based on the inclination signal.

15. The system of claim 10, wherein the controller is configured to inhibit movement of the pin to a plurality of nodes within the envelope of movement, the plurality of nodes having insufficient hydraulic capacity for the payload.

16. A method of an intelligent mechanical linkage performance of a work machine for movement of a payload, the work machine having a frame with a ground-engaging mechanism configured to support the frame on a surface, a boom assembly coupled to the frame, the boom assembly having a first section pivotally coupled to the frame and moveable relative to the frame by a first actuator, a first boom position sensor coupled to the first section; a second section pivotally coupled to the first section and moveable relative to the first section be a second actuator, a second boom position sensor coupled to the second section; and a pin coupled to the second section at a location distal from the first section, the pin having an envelope throughout which the pin is moveable by the first section and the second section, the method comprising:

transmitting a first position signal from the first boom position sensor, a second position signal from the second boom position sensor, and a load signal from a load measuring device coupled to the boom assembly and configured to generate a signal indicative of a payload, to a controller located on the work machine;

receiving the first position signal, the second position signal, and the load signal by the controller;

determining a relative position of the pin within the envelope of movement by the controller based on the first position signal and the second position signal;

calculating a map of hydraulic capacities for one or more of the first and second actuators based on the load signal and the relative position of the pin by the controller wherein the controller extrapolates values throughout the envelope of movement from the relative position of the pin, the load signal, and a theoretical performance data module; and generating a movement envelope of movement of the pin through at least a portion of an envelope of movement based on the hydraulic capacities, the movement envelope being smaller than the envelope of movement.

17. The method of claim 16, further comprising:

transmitting an inclination signal from an inclination sensor coupled to the work machine, the inclination sensor determining the inclination of the horizontal longitudinal axis of the work machine;

receiving the inclination signal by the controller; and modifying the load signal based on the inclination signal by the controller.

18. The method of claim 16, wherein the map of hydraulic capacities comprises a series of nodes representing the hydraulic capacities of one or more of the first and the second actuators throughout the envelope in real-time.

19. The method of claim 18, wherein the movement envelope further comprises a lift path of the pin from a first pin position to a second pin position through nodes with sufficient hydraulic capacity.

20. The method of claim 16 further comprising:

displaying the envelope on a user input interface through a color code based on a degree of hydraulic capacity.

* * * * *